US006485631B1

(12) United States Patent
Ellingsen

(10) Patent No.: US 6,485,631 B1
(45) Date of Patent: Nov. 26, 2002

(54) PROCESS FOR THERMAL, AND OPTIONALLY CATALYTIC, UPGRADING AND HYDROGENATION OF HYDROCARBONS

(75) Inventor: Olav Ellingsen, Florø (NO)

(73) Assignee: Ellycrack AS, Floro (NO)

( * ) Notice: Subject to any disclaimer, the term of this patent is extended or adjusted under 35 U.S.C. 154(b) by 0 days.

(21) Appl. No.: 09/492,658

(22) Filed: Jan. 27, 2000

(30) Foreign Application Priority Data

Feb. 11, 1999 (NO) ..... 990650

(51) Int. Cl.[7] ..... C10G 45/00; C10G 11/00

(52) U.S. Cl. ..... 208/142; 208/113; 208/131; 208/143; 208/125; 585/921; 585/922

(58) Field of Search ..... 208/113, 131, 208/142–143, 125; 585/921, 922

(56) References Cited

U.S. PATENT DOCUMENTS

| | | | | |
|---|---|---|---|---|
| 2,680,485 A | | 6/1954 | Bodine | 166/1 |
| 2,894,724 A | | 6/1959 | Andrew | 255/27 |
| 3,048,226 A | | 8/1962 | Smith | 166/42 |
| 3,282,826 A | | 11/1966 | Winkler | 208/8 |
| 3,520,362 A | | 7/1970 | Galle | 166/249 |
| 3,743,017 A | | 7/1973 | Fast et al. | 166/249 |
| 3,842,907 A | | 10/1974 | Baker et al. | 166/249 |
| 3,850,135 A | | 11/1974 | Galle | 166/137 A |
| 3,963,598 A | | 6/1976 | Manowitz et al. | 208/8 |
| 4,250,015 A | | 2/1981 | Yang et al. | 208/10 |
| 4,261,736 A | | 4/1981 | Dewing et al. | 75/68 A |
| 4,265,732 A | * | 5/1981 | Dinulescu | 208/106 |
| 4,287,157 A | | 9/1981 | Koch | 422/205 |
| 4,316,873 A | | 2/1982 | Koch | 422/112 |
| 4,344,835 A | | 8/1982 | Koch | 208/8 R |
| 4,344,836 A | | 8/1982 | Koch | 208/8 R |
| 4,359,091 A | | 11/1982 | Fisher et al. | 166/248 |
| 4,471,838 A | | 9/1984 | Bodine | 166/249 |
| 4,579,173 A | | 4/1986 | Rosensweig et al. | 166/248 |
| 4,884,594 A | | 12/1989 | Powers et al. | 137/625.48 |
| 5,009,272 A | | 4/1991 | Walter | 175/56 |
| 5,190,114 A | | 3/1993 | Walter | 175/56 |
| 5,282,508 A | | 2/1994 | Ellingsen et al. | 166/249 |
| 5,285,847 A | | 2/1994 | Halper et al. | 166/177 |
| 5,323,855 A | | 6/1994 | Evans | 166/248 |
| 5,465,789 A | | 11/1995 | Evans | 166/248 |
| 5,586,602 A | | 12/1996 | Vagin | 166/249 |
| 5,914,027 A | | 6/1999 | Ellingsen | 208/126 |
| 6,086,655 A | | 7/2000 | Ellingsen et al. | 75/673 |

FOREIGN PATENT DOCUMENTS

| | | |
|---|---|---|
| DE | 2737515 | 7/1979 |
| FR | 2359903 | 2/1978 |
| NO | 161697 | 6/1989 |
| NO | 175847 | 12/1994 |
| WO | WO 91/15607 | 10/1991 |
| WO | WO 94/08680 | 4/1994 |

OTHER PUBLICATIONS

"Modern Petroleum Technology", 4 edition, edited by Hobson et al., Halsted Press 1973 No Month.*

Abstract of (DE 3300365), Title: Carbonisation of Residue From Hydrogenation of Heavy Oil or Coal—In Rotating Drum, Heated in Rotating Drum, Heated Internally by Heated Carbonisation Prod. Gas. Date: Jul. 12, 1984. No Month.

Derwent's abstract, No. 79–17162B/09, week 7909, Abstract of JP, 54010274 (Sato M). Jan. 25, 1979.

* cited by examiner

*Primary Examiner*—Nadine G. Norton
(74) *Attorney, Agent, or Firm*—Merchant & Gould P.C.

(57) ABSTRACT

A process for thermal and, optionally, catalytic upgrading and hydrogenation of hydrocarbons is described, wherein the hydrocarbons (oil) with a lower API grade is passed through one or more reactors connected in parallell or in series, preferably in series, in liquid state where it under pressure and intense agitation at a given temperature is thermally upgraded by increasing API, and that the product is discharged in liquid state, and whereby the agitation is effected by whipping elements, optionally made of a catalytic material acting as a catalyst in upgrading the oil in the reactor.

5 Claims, 4 Drawing Sheets

Figure 1:
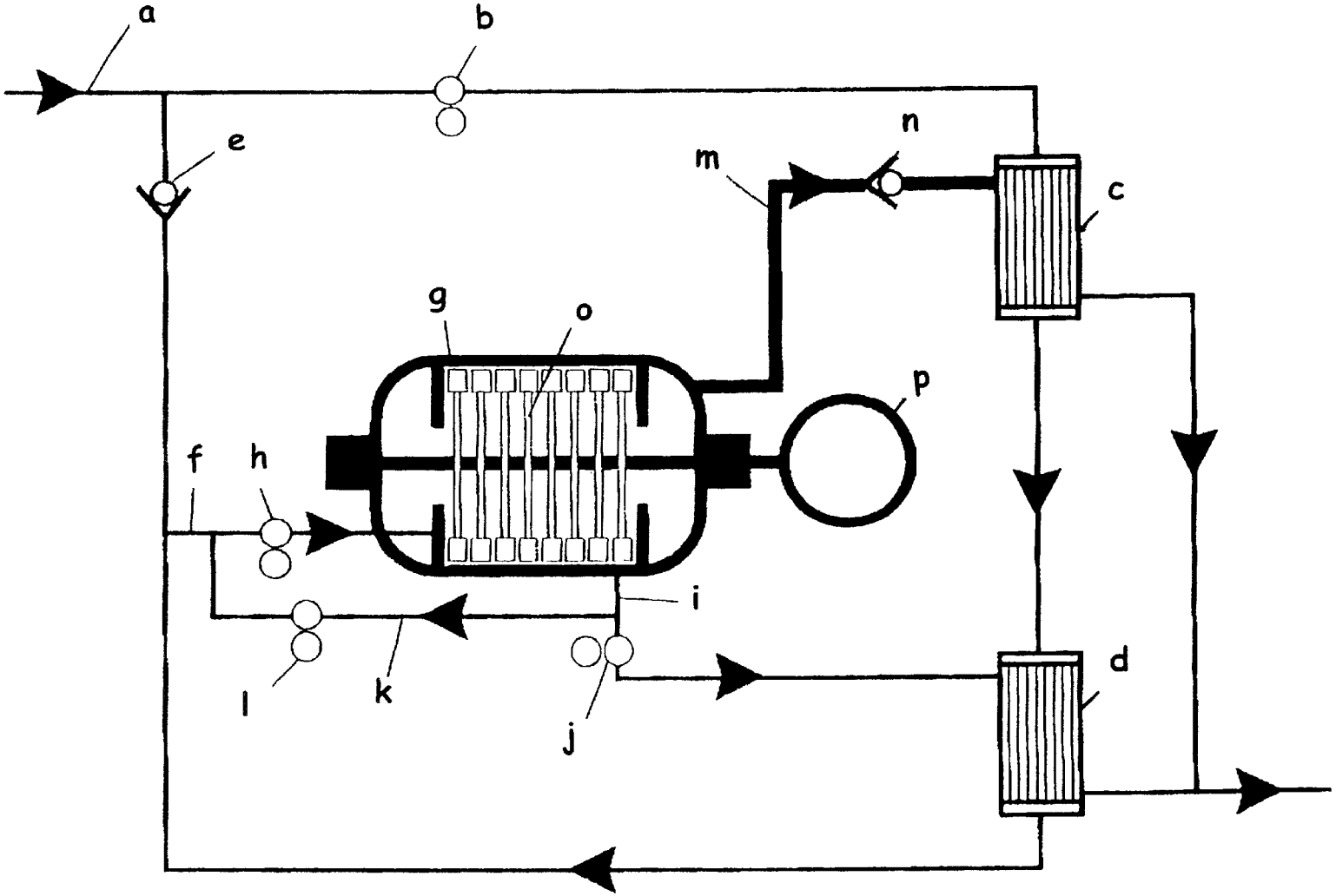

PROCESS FOR THERMAL, AND OPTIONALLY CATALYTIC, UPGRADING AND HYDROGENATION OF HYDROCARBONS

The present invention is related to a process for upgrading of heavy hydrocarbons (petroleum—crude oils) with a low API grade to a higher API grade in a reactor system involving heat, mechanical shear forces, pressure and catalytic action whereby the oil in converted into lighter fractions and its viscosity reduced.

Oil refining and the development of the internal combustion engine have continued since the latter part of the nineteenth century. Each has influenced the other in the course of this development, but it is the oil industry and its effect on almost every part of modern living that has been the most spectacular.

Crude oil is a mixture of literally hundreds of hydrocarbon compounds ranging in size from the smallest, methane, with only one carbon atom, to large compounds containing 200 or more. A major portion of these compounds are paraffins or isomers of paraffins. These are straight-chain hydrocarbon compounds such as butane, $C_4H_{10}$ which normally is denoted $nC_4$. Isobutane on the other hand is denoted $iC_4$.

The remaining hydrocarbon compounds are either cyclic paraffins called naphthenes or aromatics.

These families of hydrocarbons are called homologues, and because of the large quantity of these compounds which exist in crude oil, only the simplest of compounds in the homologues can be isolated to some degree of purity on a commercial scale. Generally, in refining projects, isolation of comparatively pure products are restricted to those compounds lighter than C7s. Most compounds, however, have been isolated and identified but only under strict and delicate laboratory conditions.

In the industry the products are restricted to groups of these hydrocarbons boiling between selective boiling ranges. Thus products are usually denoted by boiling points rather than by the compounds they contain.

Not all compounds contained in crude oil are pure hydrocarbons. The crude contains certain inorganic impurities such as sulphur, nitrogen and metals. By far the most common of these impurities are the organic sulphur compounds called mercaptans. These compounds are similar to hydrocarbons but with the addition of one or more sulphur atoms.

More complicated sulphur compounds also exist such as thiophenes in the high carbon number range homologues and disulphides in the middle distillate range. Because of the close relationship that exists between these sulphur compounds and neighbouring hydrocarbons in such characteristics as vapour pressures, the compounds can not be isolated by distillation processes on a commercial scale.

Organic chloride compounds are not usually removed from the crude as products but the corrosive effect attributed to these compounds on parts of refinery plants is always a source of concern. A considerable amount of investigation has been, and is still being, carried out on prevention of corrosion by HCI generated in the process from these organic chlorides.

The metals contained in crude are usually nickel, sodium and vanadium. Because these are not very volatile they are found in the heavier products of crude such as fuel oil. They only become a nuisance in certain cases when they can affect further processing of the oil, or if they exist in such large quantities in fuel oil as to limit the saleable value of the product. Their removal can be effected in such cases by an extraction process where they are removed as a part of a bituminous extract called asphaltenes.

Before leaving the subject of crude oil composition it is necessary to mention yet another series of organic compounds which, although not always present in the original crude, are often formed during the refining processes. These are unsaturated compounds. As mentioned earlier, most compounds contain carbon and hydrogen and are constituted in such a way that each carbon atom contains its full quota of four atoms, in the form of either hydrogen or carbon atoms. However, some of these molecules break down under conditions of high temperature and permanently lose one or more of those attached atoms. Such compounds are unstable and readily combine with themselves or other similar compounds to form polymers. They are called unsaturates while the stable hydrocarbons such as paraffins, cycloparaffins and aromatics are called saturated hydrocarbons. An example of such a compound is ethylene, which has the following formula $C_2H_4$.

Crude oil found in various parts of the world vary considerably in characteristics. This can readily be seen in the difference in specific gravity that exists between the crudes. For instance, Zelten crude (Libyan) has an API gravity of 39.0 while Bachequero crude has a gravity of 16.0. A Venezuela crude from the Orinoco basin has a gravity of 10 API. This difference is due to the fact that although each crude oil contains basically the same hydrocarbon compounds, the proportion of these hydrocarbons vary considerably from one crude to another. Thus some crudes are relatively rich in paraffins, and this is reflected by the waxy nature of the crude (most Middle East crudes fall into this group). Others contain more cycloparaffins and aromatics (such as Nigerian and some American West Coast crudes).

Although it is theoretically possible to produce any type of refined product from any crude, it is not usually economically feasible to do so. For instance, better yields of reformer stock for aromatics production is obtained from Nigerian crude than from Kuwait, while considerably more residium for fuel oil is obtained from Kuwait than Nigeria. To satisfy the demand of these two products, refineries often blend two such devious crudes, changing the proportion of the blend to satisfy the particular need. If product demands are seasonal, as in the case of many gas oils, imports of specifically selected crudes are scheduled to optimise the production of such cuts for the season.

Selectivity of crude type is comparatively easy to effect and is common practice in the refining industry where most oil companies have their own oil wells in various parts of the world. However, occasionally the demand for a particular product or the elimination of a low-value one becomes so persistent that major conversions of a chemical nature have to be adopted. Such processes as thermal and catalytic cracking and, more recently, hydrocracking are used to effect this.

In general, the products that are normally obtained from crude oil can be grouped as follows:

(1) Volatile products (these are the lightest products)
- Propane LPG (liquefied petroleum gas)
- Butane LPG
- Light naphtha (C5s and nC6)

(2) Light distillates
- Gasolines
- Heavy naphtha (petrochem naphtha and base for paints)
- Kerosene and jet fuels (3) Middle distillates
Automotive diesel
Heating oils
Gas oils
(4) Fuels oils
Marine diesel
Bunker fuels (for ships)
(5) Lubricating oils
Motor
Spindle
Machine oils
(6) Waxes
Food and paper coating grade
Pharmaceutical grade
(7) Bitumen
Asphalt
Coke Product form these groups are produced from distillation processes and treated to meet certain specifications. These specifications are the results of a compromise between desirable performance characteristics in the product and the ability to make such products from the crude and the processing facilities at hand. Wide rangs in physical properties are often tolerated in these specifications in order to cater for crude oil source, sales area and the product's ultimate use.

Thermal cracking processes are the true workhorses of the oil-refining industry. The processes are relatively cheap when compared to the fluid cracker and the hydrocracker, but go a long way to achieving the oil-cracking objective of converting low-quality material into more valuable oil products. The process family of thermal crackers has three members:

Thermal crackers
Visbreakers
Cokers

The term 'thermal cracking' is usually given to those processes that convert heavy oil (usually fuel oil or residues) into lighter product stock such as LPG, naphtha, and middle distillates by applying only heat to the feed over a prescribed element of time. When applied to a specific process the term refers to the processing of atmospheric residues (long residue) to give the lighter products. 'Visbreaking' refers to the processing of vacuum residues (short residues) to reduce the viscosity of the oil only and thus to meet the requirements of a more valuable fuel oil stock. 'Coking' refers to the most severe process in the thermal cracking family. Either long or short residues can be fed to this process whose objective is to produce the lighter distillate products and oil coke only. The coker process is extinctive-that is, it converts all the feed. In the other two processes there is usually some unconverted feed, although the thermal cracker can be designed to be 'extinctive' by recycling the unconverted oil. The three thermal cracking processes have the same basic configuration. This consists of a cracking furnace, a 'soaking' vessel or coil, and a product-recovery fractionator(s). The feed is first preheated by heat exchange with hot product streams before entering the cracking furnace or heater. The cracking furnace raises the temperature of the oil to its predetermined cracking temperature. This is always in excess of 490° C., and by careful design of the heater coils, the oil is retained in the furnace at a prescribed cracking temperature for a predetermined period of time (the residence time). In some cases an additional coil section is added to the heater to allow the oil to 'soak' at a fixed temperature for a longer period of time. In other cases the oil leaves the furnace to enter a drum which retains the oil at its cracking temperature for a short time. In the coker process the oil leaves the furnace to enter one of a series of coker drums in which the oil is retained for a longer period of time at its coking temperature for the production of coke.

The cracked oil is quenched by a cold heavy oil product stream on leaving the soaking section to a temperature below its cracking temperature. It then enters a fractionator where the distillate products are separated and taken off similar to the crude distillation unit. In the case of the cokers the coke is removed from the drums by high-velocity water jets on a regular batch basis. The coking process summarised here refers to the more simple 'delayed coking' process. There are other coking processes which are more complicated, such as the fluid coker and the proprietary Flexi coker.

The processes summarised above are the more common to be included in a fuel refinery's configuration. In addition to these there will also be gas-treating processes and often some additional gasoline octane-enhancement processes.

Within all of the above mentioned technologies, there exist a number of patents related to each of the process with proprietary information of their performances.

But all of these processes have one goal—to upgrade or refine the produced crude oils to a saleable commodity which meets the requirement of the market.

A number of the world's oil reserves consists of so-called heavy oils such as bitumen with a gravity below 16 API. Such deposits are located in countries as Canada, Trinidad, Kazakstan, Iran, Venezuela and part of the Middle East. Besides being a feed to the refineries with a reduced value, the low viscosity associated with such crude, give rise to huge transport problems of the same as the oil can not be pumped through pipelines without pre-treatment. One widespread method is to blend the low gravity oil with a higher gravity oil thus creating a pump-able blend. In addition to high gravity oil, nafta and water are also used as a blender. When using water as blender, this is always done together with an emulator which keeps the oil and water in an un-separable emulsion. Such an emulsion is the well-known Orimulsion created by crude from the Orinoco basin in Venezuela.

Even though the above mentioned processes fulfil their objectives, they are all known as is huge installations located on industrial sites (refineries). None of the known technologies are designed to be located close to the oil source (wells) with the objective to upgrade the oil before it is delivered to a traditional refinery.

The present invention aims in showing a new simplified method for upgrading heavy oil by cracking the oil whereby the transport properties of the crude is improved in addition to generate a far better feed-stock to the refinery. Furthermore the invention aims at showing that the process may be located close to the well-heads whereby a substantial savings can be obtained in transportation costs.

The process comprises of one or mere reactors arranged in series or parallel. In each reactor which is working with different temperature and pressure dependent upon the characteristics of the feed, there is arranged a rotating mixing device. The mixing device may be driven by any rotating source such as a combustion engine, electric motor, steam turbine and similar devices.

On the reactor or reactors, pipes are arranged for charge of feeding oil, discharge of produced oil, recycling of produced oil and a pipe for exhaust of generated steam and oil-gas. The feed oil is utilised as a cooling medium in the condenser in that the oil is pumped from the source through the condenser by a low pressure pump. In the condenser the oil will accumulat the heat of condensation from the evaporated effluents. The feed oil is further pumped through a heat exchanger where it is further heated by heat exchange from the produced oil leaving the reactor. The preheated feed-oil is then pumped into the reactor by a high pressure pump.

The condensed liquids from the condenser may either be charged to a separate tank system or being blended with the produced oil from the reactor.

As the process may operate with different pressure and temperature, having different residence time and may be affected catalytic by the material chosen in the part of the is mixer whipping the oil, the process is a thermal catalytic visbreaking cracking unit which combine the effects from each of these classic processes.

When the feed oil enters the reactor, it will be subject to strong shear forces from the mixer, proportional with the velocity (m/s) of the part of the mixer being in contact with the oil. The velocity and the load expressed in Watts on each element of the mixer acting on the oil is chosen such that the oil in addition to the shear forces also receives sufficient energy from the hydrodynamic energy transfer (resistance) between the oil and the elements to heat the oil to the desired process temperature. This is, on the other hand, not an absolute requirement for the process as additional energy can be delivered to the process form heated oil or water from a heat-jacket surrounding the reactor vessels. Energy may also be applied by injecting a designed amount of air or oxygen directly into the reactor to give a partial combustion of the oil in the reactor in order to heat the oil to the process temperature. When applying this, CO and $CO_2$ are generated and leaves the reactor through the gas pipe and is vented of in the condenser as non-condensable gases.

To avoid evaporation of the oil in the process and to optimise the thermal load on the oil and increase efficiency, the reactor is pressurised at a pressure whereby the boiling point of the fraction of the oil in the reactor is higher than the operating temperature. Water in the feed oil will normally be evaporated under the existing conditions in the reactor related to temperature and pressure.

Exhaust of evaporated water and oil gas which may be driven off by the steam expansion, leave the reactor through the gas pipe including a pressure valve set to the actual reactor pressure. Thus, the effluents are entering the condenser at a pressure of approx. 1,1 bar.

The oil which is charged into the reactor will, due to the aggitation, be put into a rotating movement against the opposite end of the reactor. During this movement, the oil will be exposed to the mentioned shear forces and the catalytic effect from the material in the whipping elements and will be heated to the desired process temperature. In the opposite end of the reactor there is arranged a discharge pipe including a discharge device which may be a gear-pump or a valve. When process temperature is reached, the discharge device is activated and product is discharged with the consequence that the load on the drive drops. The reduced load activates the feed pump to maintain the load of the drive.

By certain types of oils it is necessary to increase the residence time in the reactor. To achieve this, a by-pass is arranged between the discharge pipe and the feed-pump whereby a portion of the oil in the reactor can be pumped back into the reactor.

The volume of pump around is dictated by the characteristics of the feed-oil and to what level upgrading is wanted.

Upgrading can furthermore be increased by having reactors operating with different pressure and temperature in series whereby the oil is pumped from the first reactor to the next and so on and is dischared in the last reactor as mentioned above. By this arrangement one or more of the reactors may act as a soaking or flash vessel. When operating as a soaking vessel, the reactor is given more or less the same temperature and pressure as in the previous reactor whereby the oil under agitation can soak a given time. When operating as a flash vessel, the reactor is operating at the same temperature but a reduced pressure whereby the accumulated energy in the oil will cause portion of the fractions in the oil to flash-evaporate which for some crude might be advantageous. The gases leaving the flash vessel can either be condensed in one operation or be separated further in a destillation column.

Furthermore the reactor can be made with different diameters whereby the velocity of the elements attached to the mixer will increase by increasing diameter. The increased velocity will give rise to increased mechanical shear forces. By such arrangement the reactor is operating under the same pressure and temperature.

As the energy can be delivered to the oil in the reactor in-situ, the theoretical energy-consumption to operate the process is equal to the caliometric energy requirement to heat the oil to the process temperature and the enthalpy in the steam and oil gas leaving the reactor through the gas pipe.

Still another feature of the invention is that the whipping elements have slots which change the direction of the oil thus creating momentum of bending force and increased mechanical shear forces and increased contact area to be affected by the catalytic effect from the material in the elements.

Below the process is described in more detail with the reference to the following drawings:

FIG. 1 shows a simplified flow-diagram of the process having one reactor. a) shows the feed-line from the oil source. The oil is sucked to the low pressure pump b) which pumps the feed oil to the condenser c). From the condenser it is further pumped through the heat exchanger d) and via a backstroke valve e) to the feed side of the pump b).

Between the backstroke valve e) and the heat-exchanger d) the feed pipe f) to the reactor g) is arranged. In the pipe f) a high pressure feed pump h) is located which pumps the oil into the reactor g). In the opposite end of the reactor g), is arranged a discharge pipe i) with a discharge device j). Between the discharge pipe i) and before the discharge device j) is arranged a by-pass pipe k) with a circulation pump 1) which pumps roundabout oil to the suction side of feed pump h).

Oil from the discharge device j) is pumped through the heat exchanger d) where the feed oil is heated. The product oil leaves the heat exchanger and blended, with the condensed liquids from the condenser c), it is pumped to the receiver.

The vapours leave the reactor g) via the gas pipe m) via the backstroke pressure valve n) set to open at the operating pressure in the reactor.

The mixer or stirrer o) in the reactor is driven by a drive p).

Figure 2:
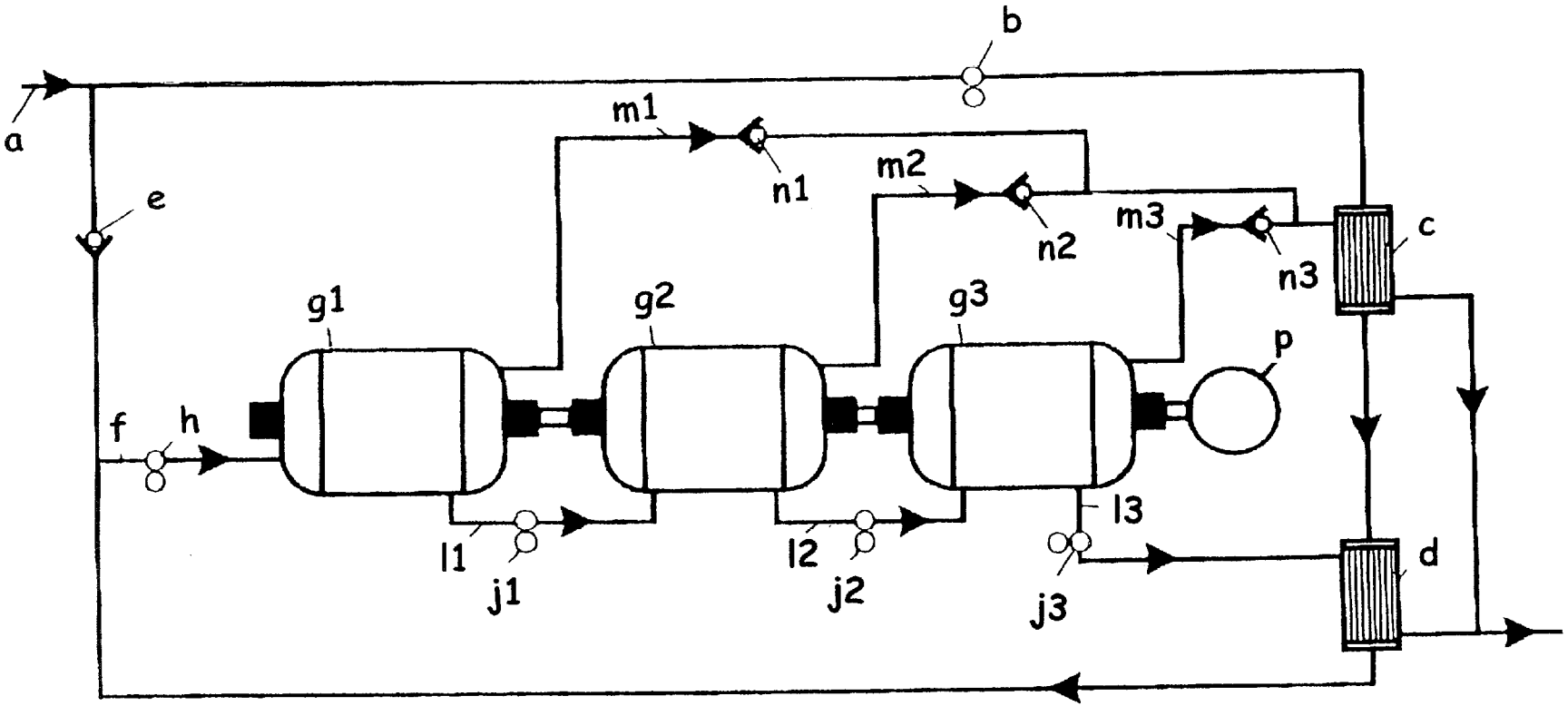

FIG. 2 shows the principle lay-out of the process having 3 reactors g1); g2 and g3). The denotation x1; x2 and x3 referees to FIG. 1 whereby the drawing should be self-explaining.

Figure 3:
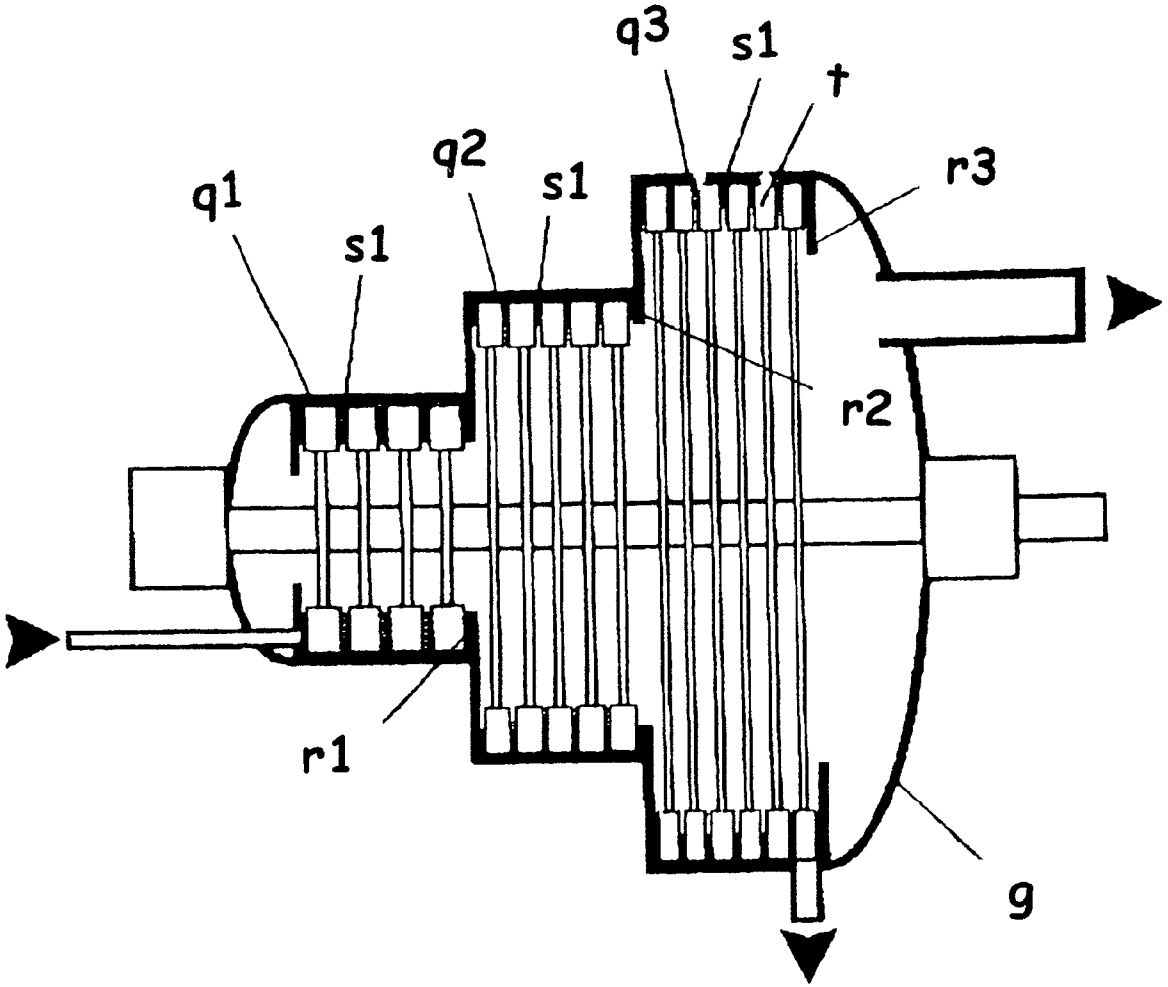

FIG. 3 shows a lay-out of a stepwise reactor g) having 3 different steps q1; q2 and q3. Between each stem is arranged rings r) which makes it possible to establish a "fluid bed" s) at each segment when in operation. The elements t) whipping the oil may have different geometrical shapes and widths for each element.

Figure 4:
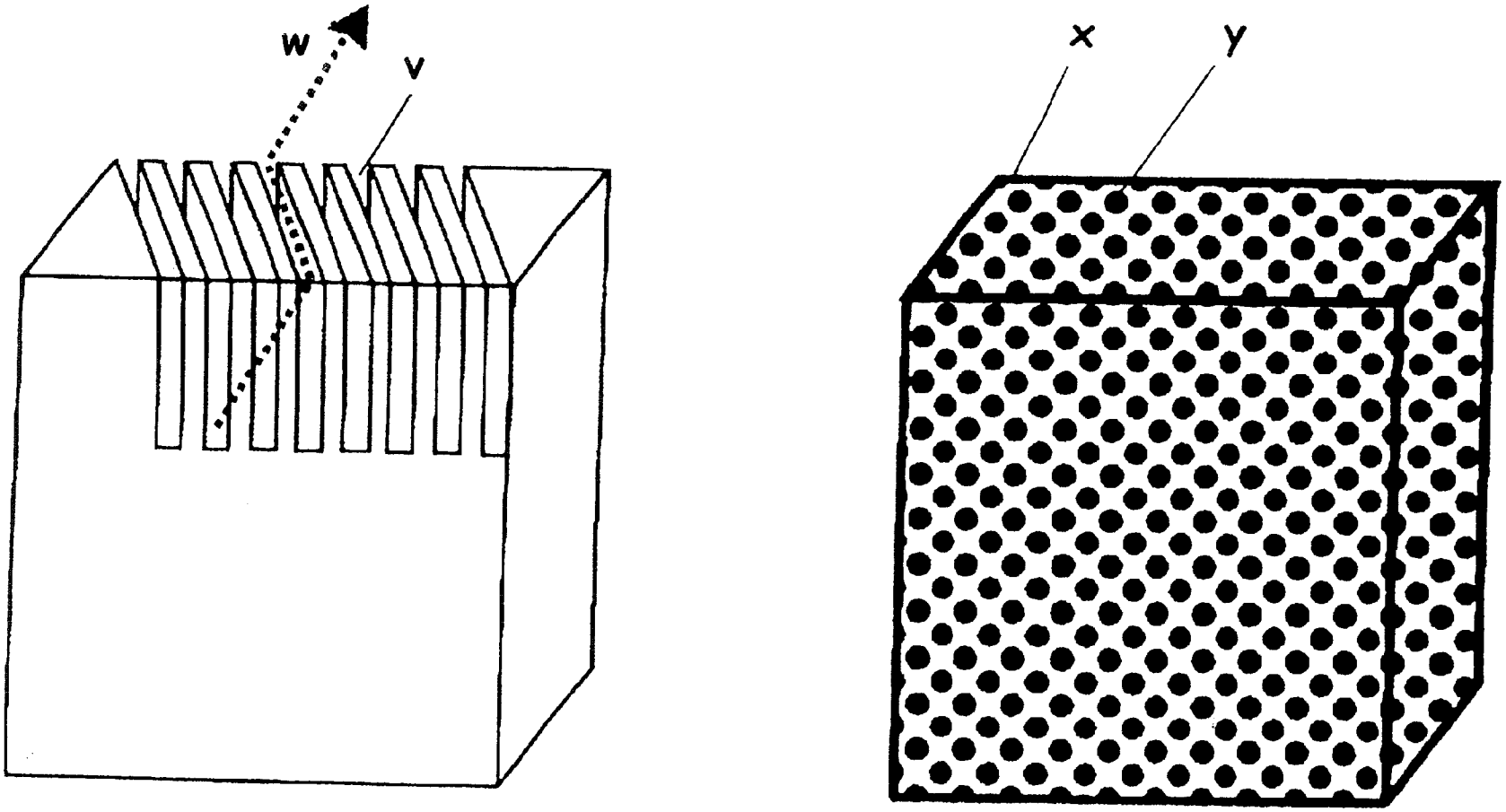

FIG. 4 shows preferred embodiments of the element. u) shows an element having several slots v) milled into the element whereby the oil will be given a path illustrated with the line w). Element x shows an element made up of porous metal having pores y) which allows the oil to pass through the element given a resistance due to the pore-radii's and pore-path through the element.

As described previous the reactor is operating under a pressure above atmospheric pressure. The pressure may be in the order of 5 to 100 bars—preferably 10–20 bars. When the elements move in the oil with a velocity between 30–200 m/s, preferably 75 m/s, a pressure front is created at the face of the element. Due to the pressure-loss by passing the element, a reduced pressure will appear behind the element analog to an aeroplane wing. This will lead to the fact that we have 3 pressure conditions in the reactor. The bulk-pressure $p_b$. The pressure $p_f>p_b$ at the face of the element and a pressure $p_{bc}<p_b$ behind the element. These pressure conditions may be optimised according to the characteristic of the oil to upgrade.

A simplified calculation of a typical scenario will illustrate the efficiency of the process.

Assuming a low-gravity oil of 10 API containing 5 w% water. Operating pressure in the reactor is 15 bars. Operating temperature is 250° C. Under this conditions we assume that the water is evaporated together with 5% of the oil. The total energy consumption to heat the oil and evaporate the effluent is simplified expressed by:

$$Q=m_o*c_o*dt+m_o*x_o*r_o+m_w*dH$$

Where:

$m_o$=oil feed=0.95 kg $c_o$=average specific heat of oil=approx. 2.5 kJ/kg° C.

dt=temperature difference from feed temperature to process temperature=approx. 225° C.

$x_o$=Evaporated part of oil=approx. 5%.

$r_o$=Heat of evaporation of oil=approx. 275 kJ/kg $m_w$=Evaporated water=0.05 kg dH=Enthalpy of water=approx. 3000 kJ/kg Note! This are average values. Accurate calculations requires that each fraction is calculated in accordance with their specific heat and heat of evaporation. The calculation only gives an average expression of the efficiency.

Q=751 kJ/kg.

By heat-recovery as explained above we have:

Energy in evaporated gases are:

$$Q_g=m_o*x_o*(co*dt+r_o)+m_w*dH=m_o*dt_1+m_w*c_w*dt_1$$

$Q_g$=254 kJ

Heat of condensation is:

$$Q_c=m_o*x_o*r_o+m_w*r_w$$

Where:

$r_w$=2250 kJ/kg $Q_c$=126 kJ

The feed liquid (oil and water) will be heated to:

$$dt_1=Q_c/(m_o*c_o+m_w*c_w)$$

$dt_1$=45° C.

Assuming a discharge temperature of the product from the heat-exchanger to be 60° C. (this is within the range of the heat-exchanger). Absorbed energy by the feed-oil is thus:

$$Q_o=(m_o-m_o*x_o)*c_o*dt_2$$

Where:

$dt_2$=250−60=190° C.

$Q_o$=470° C.

The feed-oil is thus heated further to:

$$dt_3=Q_o/m_o*c_o+m_w*c_w)$$

$dt_3$=165° C.

This the charge-temperature of feed oil is:

$$t_f=dt_1+dt_3$$

$t_f$=225° C.

The total energy-consumption by the heat recovery is thus:

$$Q_{hr}=m_o*c_o*dt_4+m_o*x_o*r_o+m_w*dH$$

Where:

$dt_4$=250−225=25° C.

$Q_{hr}$=229 kJ/kg

Related to one bbl of oil, we have energy consumption:

$$Q_{bbl}=Q_{hr}*159*0,9$$

$Q_{bbl}$=32.778 kJ/bbl=9,1 kWh

With US$ 0.1 /kWh this gives approx. $ 1.–/bbl in energy costs.

A designed unit of 450 kW is thus able to process 1100 bbl/day.

Still another feature with the process is that it may be used as a hydrogenation process under the same conditions. Normal hydrogenation plants operates at high temperatures and pressure in excess of 135 bars. Because of the pressure at the face of the moving element, the oil is being exposed at the same pressure during its movement along the reactor. By supplying hydrogen or hydrogen delivering agents to the reactor, hydrogen will saturate unsaturated hydrocarbons and thus increase the upgrading and the quality of the oil.

Still another important feature with the process is that it will not form any coke since the oil is not vaporised and is discharged in its liquid state. Should small amount of finelt divided coke be formed, it will blend with the oil and follow the discharged oil whereby no by-products need to be handled on site by the reactor.

By an experimental reactor having a 20 kW motor and a reactor with a diameter of 350 mm and a length of 500 mm, we obtained upgrading of residue from a vacuum destination plant with a gravity of 0.935 kg/dm$^3$ to 0.845 kg/dm$^3$.

What is claimed is:

1. A process for thermally upgrading and hydrogenating hydrocarbons, the process comprising steps of:

passing hydrocarbons having a lower API grade through one or more reactors that are connected either in parallel or in series;

pressuring the hydrocarbons;

agitating the hydrocarbons within the one or more reactors via whipping elements comprising a catalytic material, thereby forming a product having an increased API grade; and discharging the product having an increased API grade in at least a partially liquid state.

2. A process for thermally upgrading and hydrogenating hydrocarbons, the process comprising steps of:

passing hydrocarbons having a lower API grade through one or more reactors that are connected either in parallel or in series, wherein the one or more reactors operate at a different temperature and pressure;

pressuring the hydrocarbons;

agitating the hydrocarbons within the one or more reactors via whipping elements, thereby forming a product having an increased API grade; and discharging the product having an increased API grade in at least a partially liquid state.

3. The process of claim 2, wherein evaporated effluent from each of the one or more reactors is exhausted to a condenser and product from each of the one or more reactors is pumped to a receiver.

4. A process for thermally upgrading and hydrogenating hydrocarbons, the process comprising steps of:

passing hydrocarbons having a lower API grade through one or more reactors that are connected either in parallel or in series, wherein at least one of the one or more reactors comprise a reactor having a stepwise increasing diameter, resulting in a velocity at each diameter that is different than a velocity at a preceding diameter;

pressuring the hydrocarbons;

agitating the hydrocarbons within the one or more reactors via whipping elements, thereby forming a product having an increased API grade; and discharging the product having an increased API grade in at least a partially liquid state.

5. A process for thermally upgrading and hydrogenating hydrocarbons, the process comprising steps of:

passing hydrocarbons having a lower API grade through one or more reactors that are connected either in parallel or in series, wherein at least one of the one or more reactors comprises a soaking and flash vessel for product from a previous reactor, the soaking and flash vessel has either the same pressure and temperature or the same temperature and lower pressure as the previous reactor;

pressuring the hydrocarbons;

agitating the hydrocarbons within the one or more reactors via whipping elements, thereby forming a product having an increased API grade; and discharging the product having an increased API grade in at least a partially liquid state.

* * * * *